US011752795B1

(12) United States Patent
Schneider

(10) Patent No.: US 11,752,795 B1
(45) Date of Patent: Sep. 12, 2023

(54) SELF-STANDING DESKTOP CALENDAR WITH A FOLDABLE GRAPHIC PANEL

(71) Applicant: Oran Schneider, Bar Yohai (IL)

(72) Inventor: Oran Schneider, Bar Yohai (IL)

( * ) Notice: Subject to any disclaimer, the term of this patent is extended or adjusted under 35 U.S.C. 154(b) by 0 days.

(21) Appl. No.: 17/858,069

(22) Filed: Jul. 6, 2022

(51) Int. Cl.
*B42D 5/04* (2006.01)

(52) U.S. Cl.
CPC ..... *B42D 5/047* (2013.01); *B42D 5/04* (2013.01); *B42D 5/041* (2013.01)

(58) Field of Classification Search
CPC ..... B42D 5/04; B42D 5/047; B42D 5/041
USPC ..... 283/2
See application file for complete search history.

(56) References Cited

U.S. PATENT DOCUMENTS 5,022,681 A * 6/1991 Penick ..... B42D 15/0073 446/148
6,493,969 B2 * 12/2002 Devos ..... B42D 5/043 40/119

FOREIGN PATENT DOCUMENTS

KR 20090001122 U * 2/2009
KR 20090001123 U * 2/2009
KR 100971037 B1 * 7/2010
WO WO-2009017315 A1 * 2/2009 ..... B42D 5/041

OTHER PUBLICATIONS

KR20090001122U English Translation (Year: 2009).*

* cited by examiner

*Primary Examiner* — Kyle R Grabowski

(57) ABSTRACT

A desktop calendar that has first and second rigid panels with top portions that are connected to each other, a plurality of pages each has a top portion with apertures that are rotatably connected to the top portions of the rigid panels by rings or a spool. The calendar also includes a graphic panel that can be at a flat state or an open state, and that includes a front and back panels that are connected to each other along a folded line. A front bottom edge of the front panel is foldabley connected to a front side of a first page, and a back bottom edge of the back panel is foldabley connected to a back side of a second page that is adjacent to the first page.

6 Claims, 14 Drawing Sheets

SELF-STANDING DESKTOP CALENDAR WITH A FOLDABLE GRAPHIC PANEL

FIELD OF THE INVENTION

The present invention refers to a self-standing desktop calendar with a Foldable Graphic Panel.

BACKGROUND ART

It is customary to use self-standing desktop calendars as a means of advertising, and the goal of every advertiser is that the person who receives the calendar will put it on the table for all the year and not throw it into a forgotten drawer, preferring a calendar of another advertiser. Hence, there is a demand of the market for attractive calendars. The present invention discloses an innovative self-standing desktop calendar that meets this requirement.

DESCRIPTION OF THE DRAWINGS

The intention of the drawings attached to the application is not to limit the scope of the invention and its application.

The drawings are intended only to illustrate the invention and they constitute only one of its many possible implementations.

THE INVENTION

Figure 1:
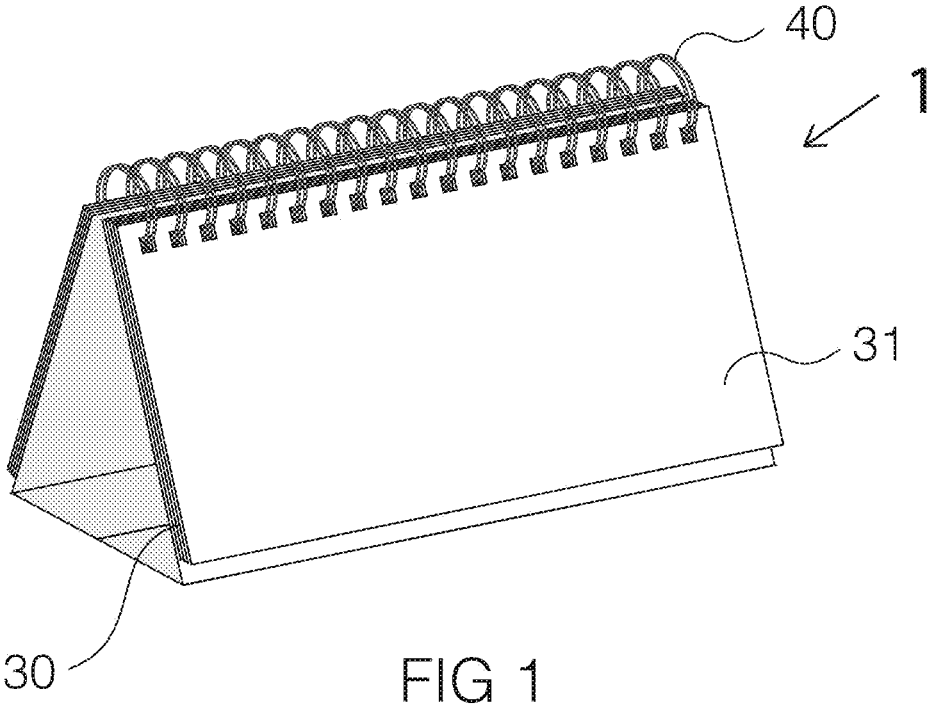
FIGS. 1 and 2 depict the self-standing desktop calendar.

The objective of the present invention is to provide a self-standing desktop calendar (1) that includes the following elements:

(a) a first rigid panel (21) that has a top portion (210) and a second rigid panel (22) that has a top portion (220). The top portion of the first rigid panel is connected to the top portion of the second rigid panel. The top portions of the first and the second rigid panels are connected to each other, by rings or spools further, or attached to each by glue or that they can be form from one sheet that is folded.

(b) a plurality of pages (30) that comprises at least a first page (31), a second page (32), a third page (33) and a fourth page (34). Basically calendars comprise twelve pages for twelve months, but there are calendars with more or less pages.

Each page has a top portion (310) (320) (330) (340) with plurality of apertures (311) (321) (331) (341). The top portions of the plurality of pages are rotatably connected to the top portions of the first and the second rigid panels by plurality of rings (40) or a spool (41) passing through the apertures of said plurality of pages.

(c) a first graphic member (51) that comprises a first front panel (51F) having a first front bottom edge (512F) and a first back panel (51B) having a first back bottom edge (512B). The first front panel and the first back panel are connected one to the other along a first central folded line A-E. The folded line can be full on the panel or two or more parts when exists spaces or cuts on the pages. The first front bottom edge (512F) of the first front panel is foldabley connected to the first page (31), and the first back bottom edge (512B) of the first back panel is foldabley connected to the second page (32) that is adjacent to the first page.

The first graphic member is designed to be folded into a flat state when the first and the second pages are tight to each other throughout their area, and to unfold into an open state when the first page is turned back.

Figure 2:
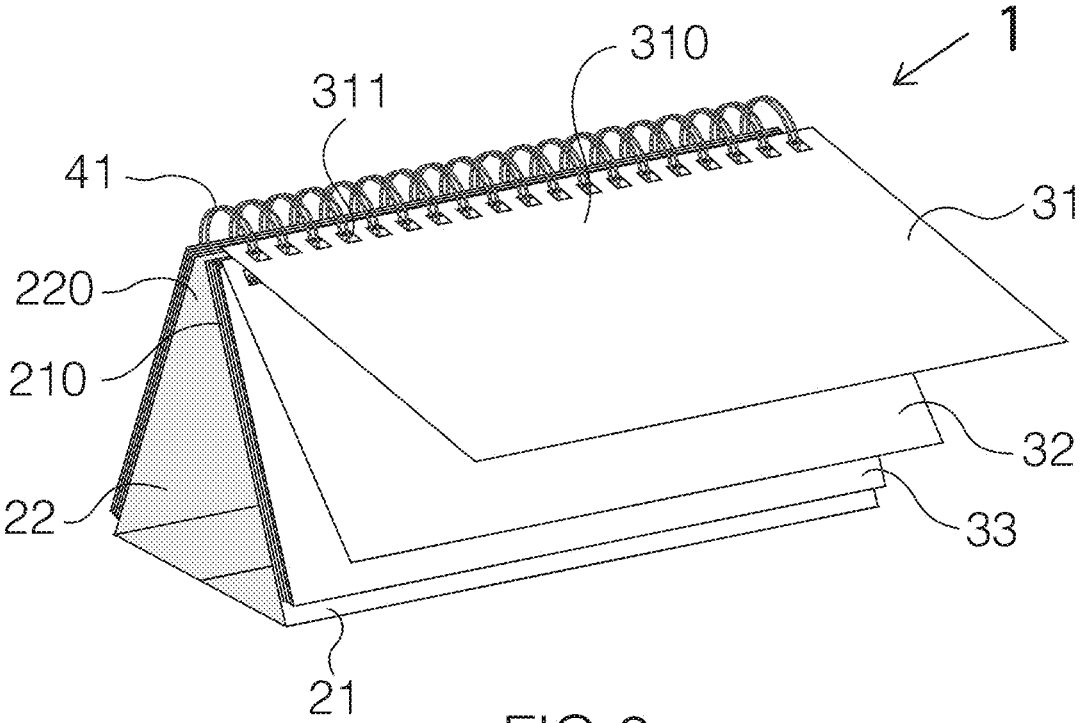
Figure 3:
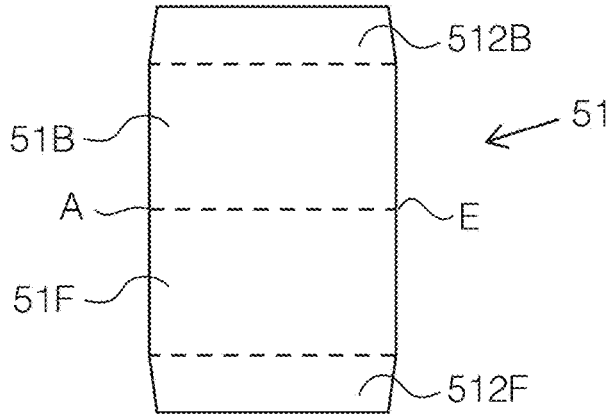
FIG. 3 depicts the first graphic member (51) separately and in a flat state.
Figure 4:
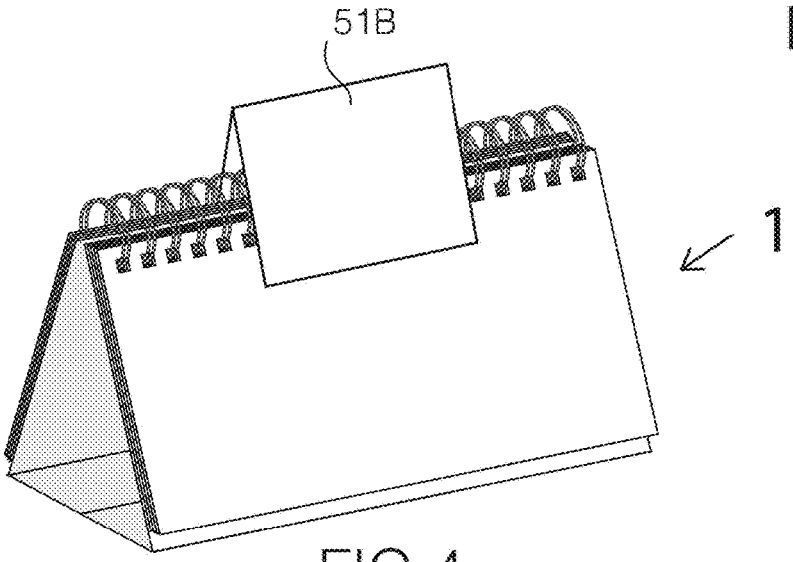
FIG. 4 depicts a back view of the calendar in which the first graphic member (51) is in the open state.
Figure 5:
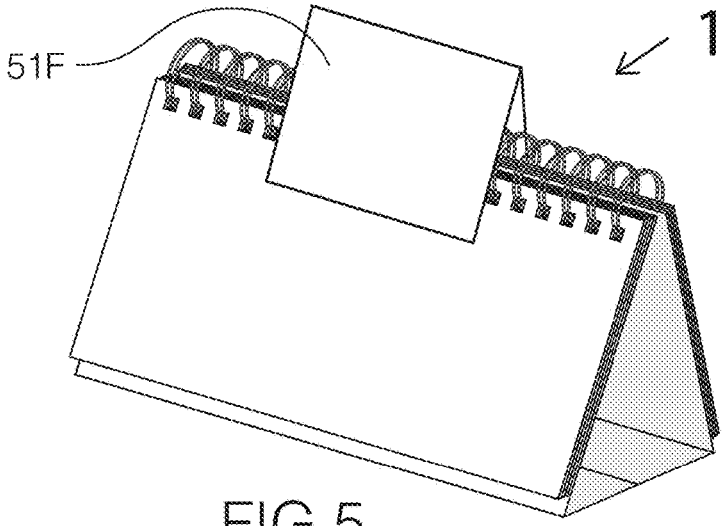
FIG. 5 depicts a front view of the calendar in which the first graphic panel (51) is in the open state.
Figure 6:
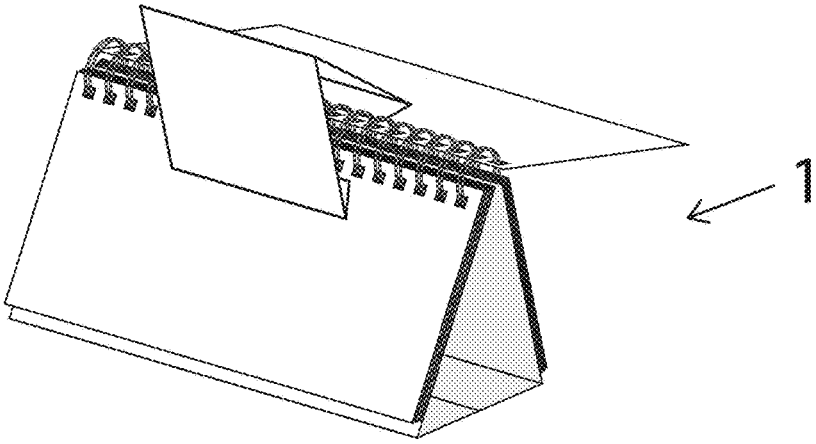
FIGS. 6-8 depict the calendar during the turning back of the pages.
Figure 7:
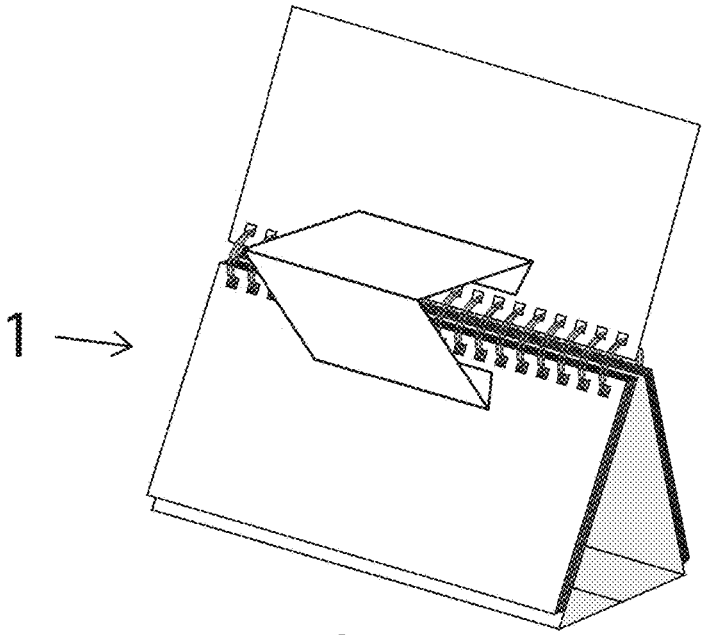
Figure 8:
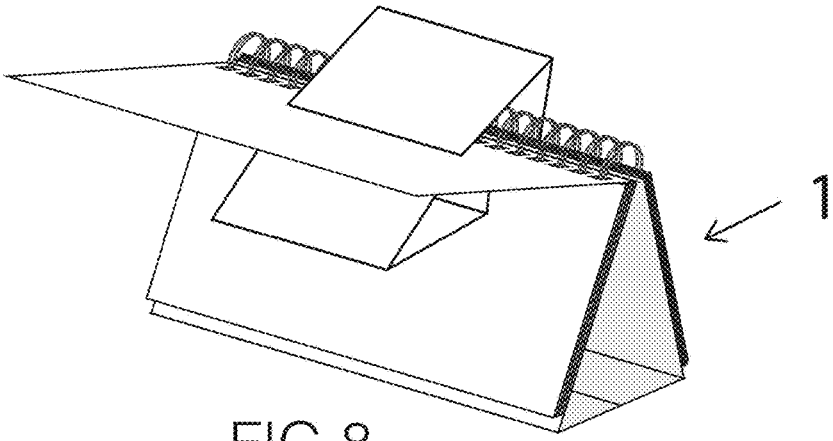
Figure 9A:
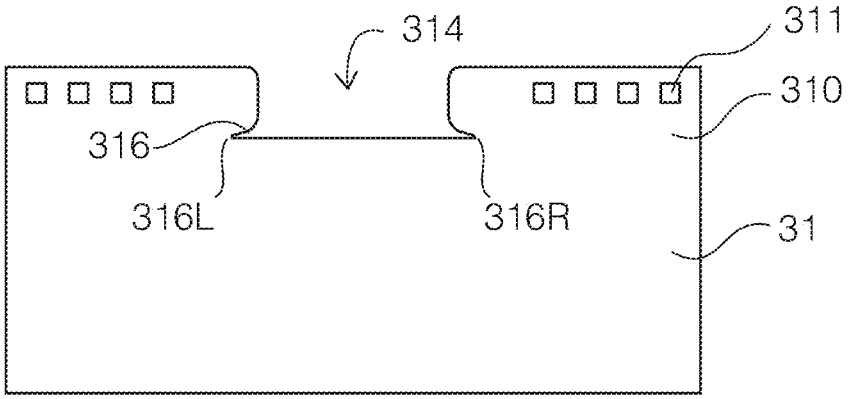
FIGS. 9A-9D depict four pages (31) (32) (33) (34).
Figure 9B:
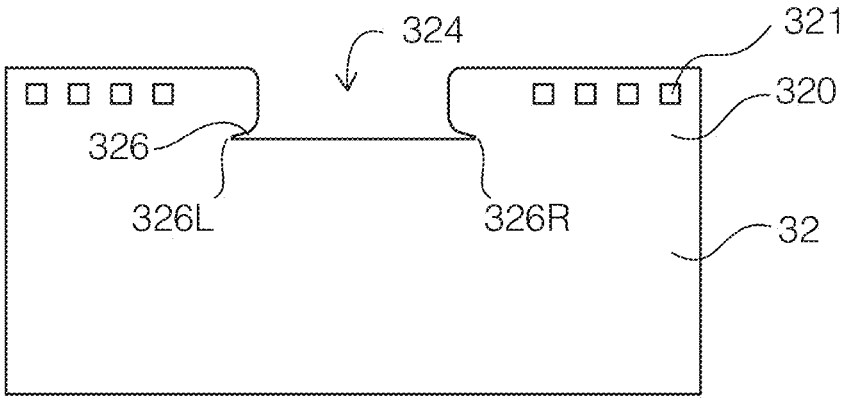
Figure 9C:
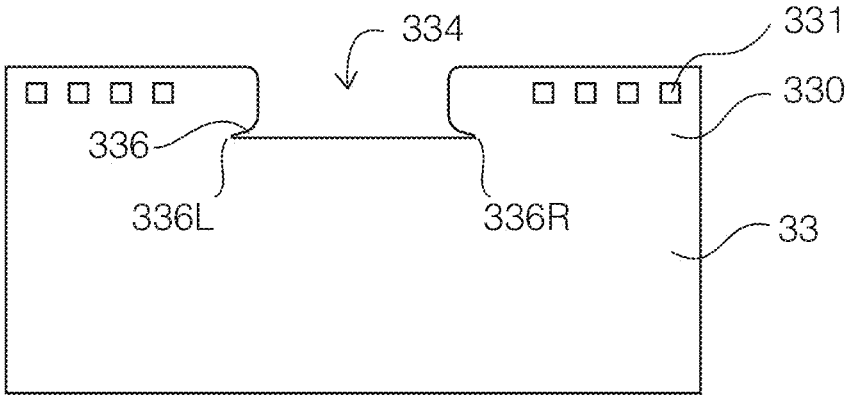
Figure 9D:
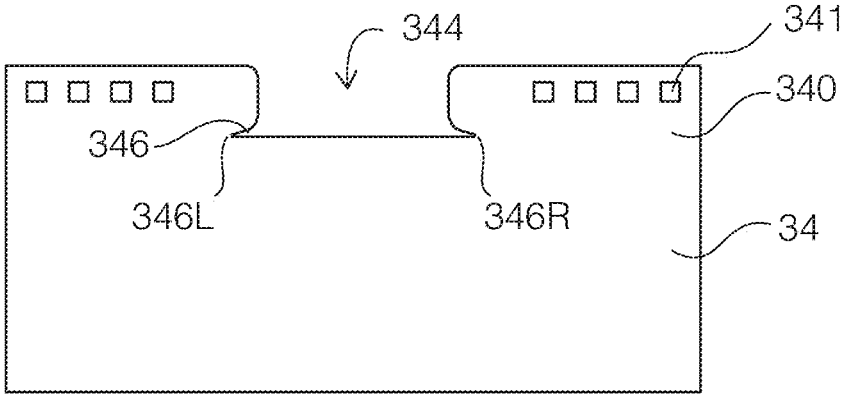

FIGS. 1 and 2 depict the self-standing desktop calendar, FIG. 3 depicts the first graphic member (51) separately and in a flat state, FIG. 4 depicts a front view of the calendar in which the first graphic member (51) is in the open state, FIG. 5 depicts a back view of the calendar in which the first graphic panel (51) is in the open state, and FIGS. 6-8 depict the calendar during the turning back of the pages.

It is understood from the above that each graphic member is connected to two adjacent pages. When the graphic member is between the two adjacent pages to which it is attached when they are tight to each other, then it is in a folded and flat state. When turning back the page to which the graphic member is attached (by glue or any other way) to the open state as shown in FIGS. 4 and 5, then the member goes to an open state where it is higher than the calendar and the graphics on it are visible. Then, when the adjacent page to which the graphic member is attached is also turned over, then the graphic member moves to a flat folded state and is hidden between these two tight pages. And so on, with the second graphic member, the third member, the fourth member and so on.

The self-standing desktop calendar may include a second graphic member (52) that comprises a second front panel (52F) with a second front bottom edge (522F) and a second back panel (52B) with a second back bottom edge (522B). The second front panel and the second back panel are connected one to the other along a second central folded line B-F. The second front bottom edge (522F) of the second front panel is foldabley connected to the second page (32), and the second back bottom edge (522B) of the second back panel is foldabley connected to the third page (33) that is adjacent to the second page. The second graphic member is designed to be folded into a flat state when the second and the third pages are tight to each other throughout their area, and to unfold into an open state when the second page is turned back.

The self-standing desktop calendar (1) may include a third graphic member (53) that comprises a third front panel (53F) having a third front bottom edge (532F) and a third back panel (53B) having a third back bottom edge (532B). The third front panel and the third back panel are connected one to the other along a third central folded line C-G. The third front bottom edge (532F) of the third front panel is foldabley connected to the third page (33), and the third back bottom edge (532B) of the third back panel is foldabley connected to the fourth page (34) that is adjacent to the third page, the third graphic member is designed to be folded into a flat state when the third and the fourth pages are tight to each other throughout their area, and to unfold into an open state when the third page is turned back.

In another embodiment of the self-standing desktop calendar (1) the first, second, third and fourth pages may have an upper notch (314) (324) (334) (344) with a main connecting means (316) (326) (336) (346), and also it is possible that each of said first, second and third graphic members has a secondary connecting means (614) (624) (634), that corresponds with the main connecting means. In addition to that, it is possible that each of said first, second and third graphic members may have a non-straight central cut (616) (626) (636) to increase its beauty and visibility.

In this version of calendar, the first back bottom edge of the first back panel of the first graphic member is foldabley connected to the second page by the main connecting means of the first graphic member and the secondary connecting means of the second page, the second back bottom edge of the second back panel of the second graphic member is foldabley connected to the third page by the main connecting means of the second graphic member and the secondary connecting means of the third page, and the third back bottom edge of the third back panel of the third graphic member is foldabley connected to the fourth page by the main connecting means of the third graphic member and the secondary connecting means of the fourth page.

In another embodiment of the self-standing desktop calendar (1) each of said main connecting means is of a type of a right cut (316R) (326R) (336R) (346R) and a left cut (316L) (326L) (336R) (346L) that projects into each of said pages from each of said notches, and each of said secondary connecting means is of a type of a straight right cut (614R) (624R) (634R) and a straight left cut (614LR) (624L) (634L) in the left and right ends (613R) (623R) (633R) (613L) (623L) (633L) of each back folding line.

In another embodiment of the self-standing desktop calendar (1) each of said main connecting means is of a type of a vertical tab (319) (329) (339) (349), and each of said secondary connecting means is of a type of a cut along part of said back folding straight line (619) (629) (639) (649).

The calendar (1) may include the same number of graphic panels as the number of its pages and in case of a yearly calendar to have 12 graphic panels that each may bear an interesting graphics and text.

It is possible that the graphic members can be connected to each other, and each graphic member can be positioned between two adjacent pages. When the graphic member is between the two adjacent pages to which it is assembled when they are adjacent and tight to each other, then it is in a folded and flat state. When turning the page to which the graphic member is assembled to the open state as shown in the drawings, then the panel goes to an open state where it is higher than the calendar and the graphics on it are visible. Then, when the adjacent page to which the graphic member is attached is also turned over, then the graphic member moves to a flat folded state and is hidden between these two pages. And so on, with the second graphic member, the third member, the fourth member and so on. The calendar (1) may include the same number of graphic members as the number of its pages and in case of a yearly calendar to have 12 graphic members that each may bear an interesting graphics and text.

Figure 10:
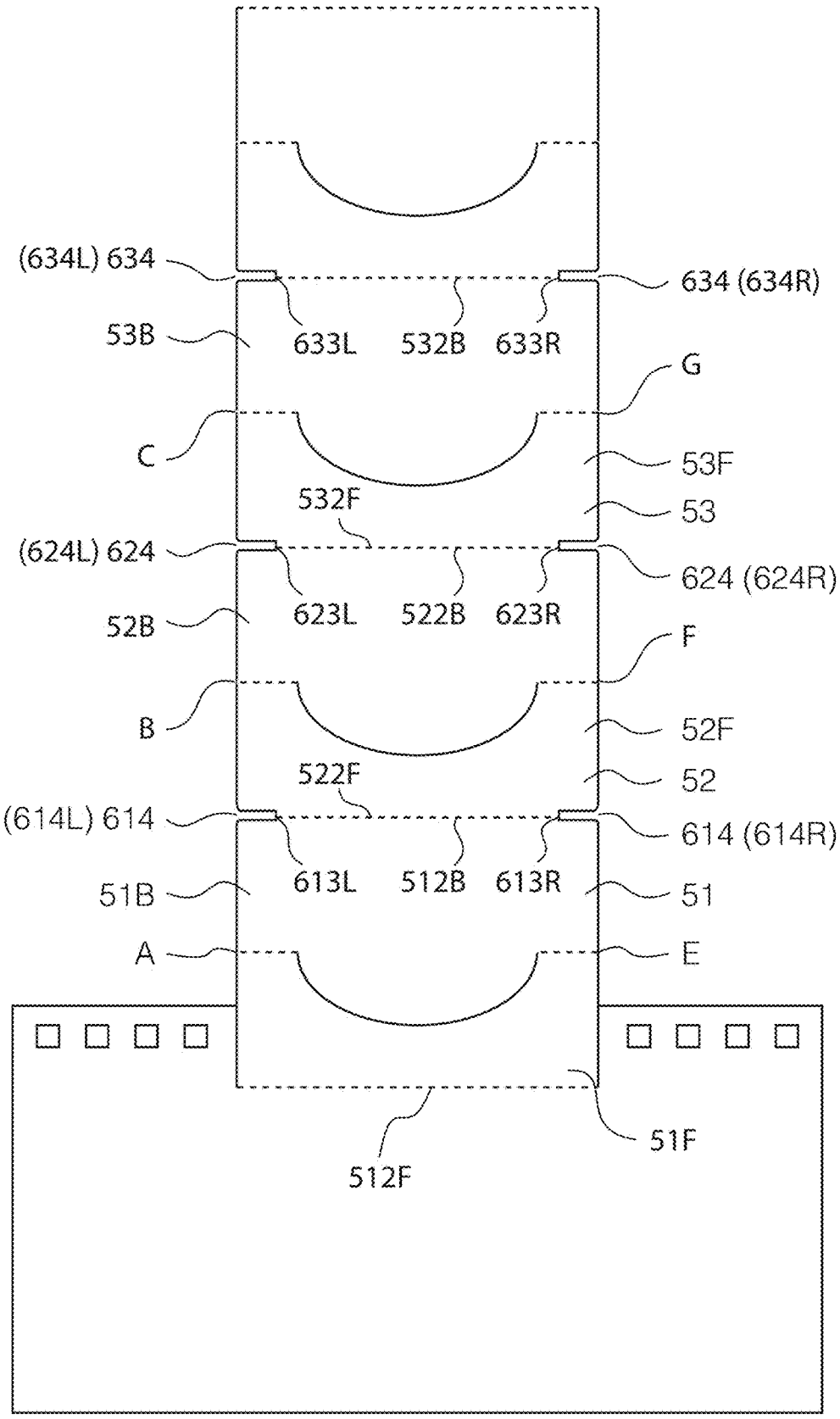
FIG. 10 depicts the first, second, third and one more graphic members when they are connected to each other.
Figure 11:
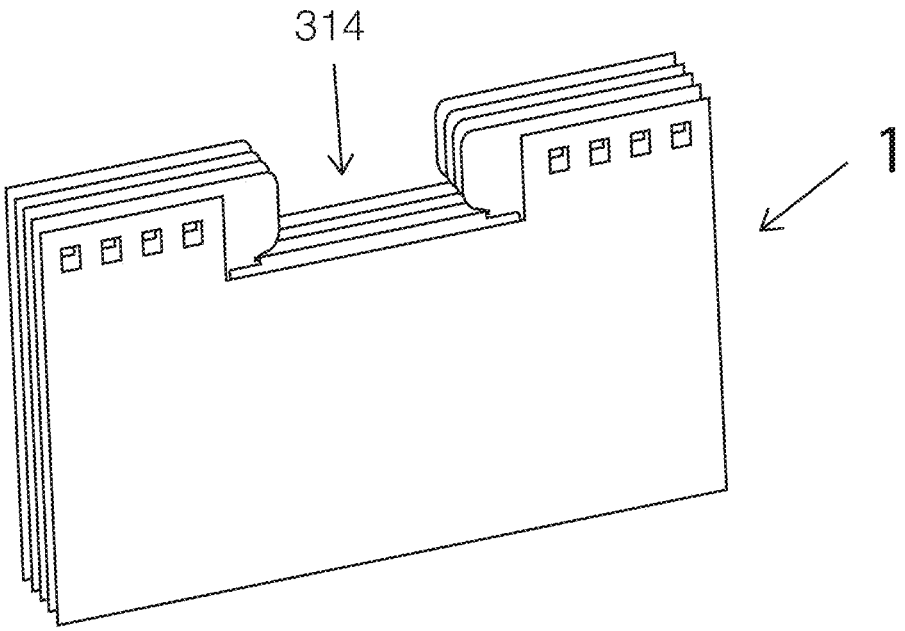
FIG. 11 depicts the pages with the notches.
Figure 12:
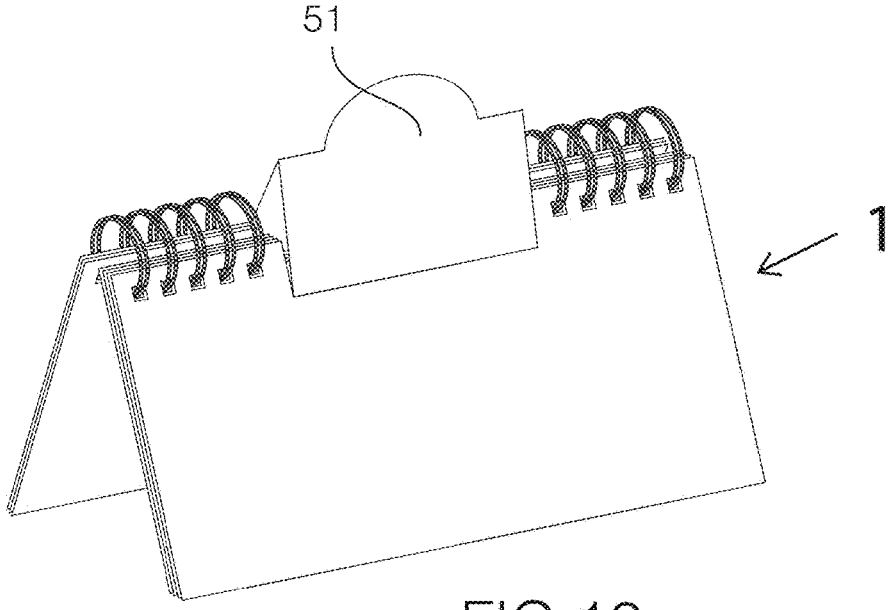
FIGS. 12 and 13 depict the calendar in few states.
Figure 13:
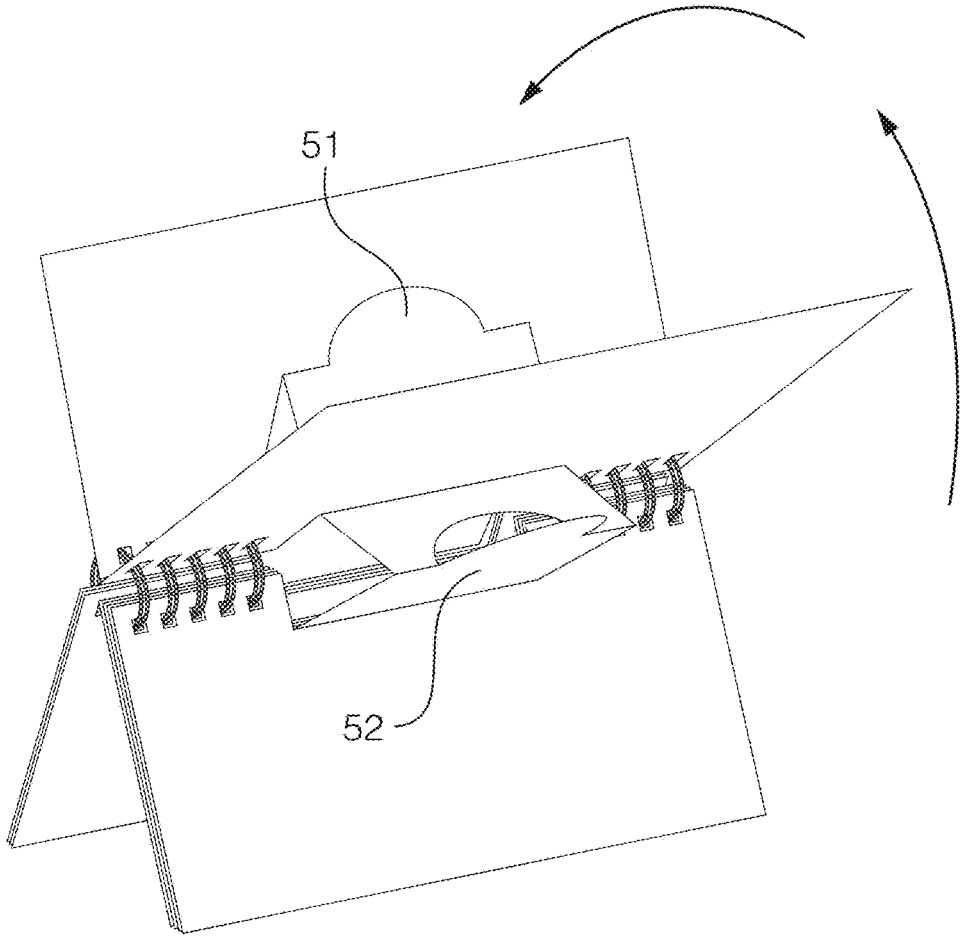
Figure 14A:
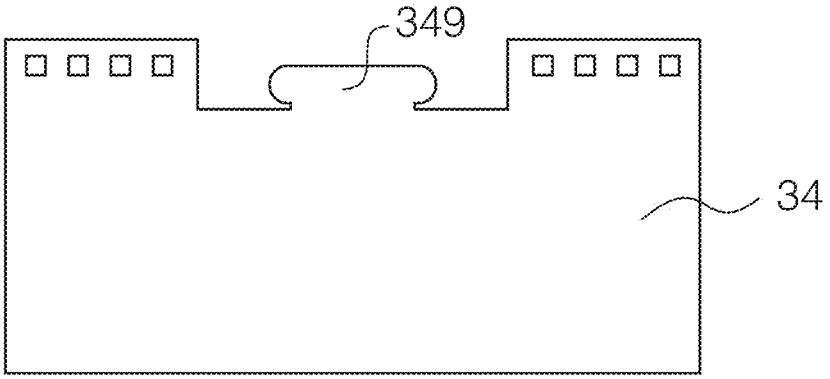
FIGS. 14A-14D depict four pages (31) (32) (33) (34).
Figure 14B:
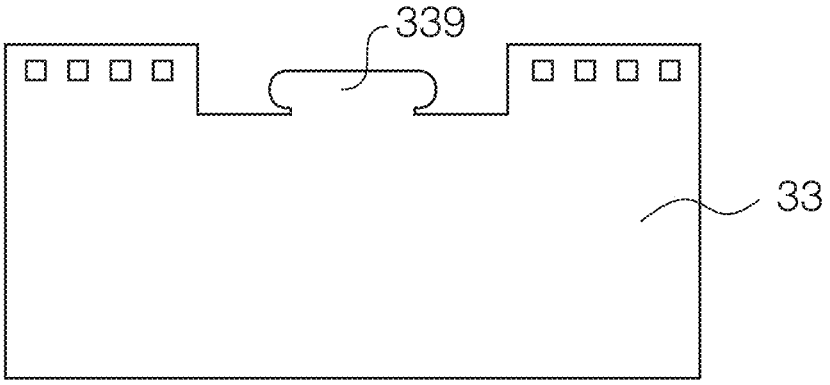
Figure 14C:
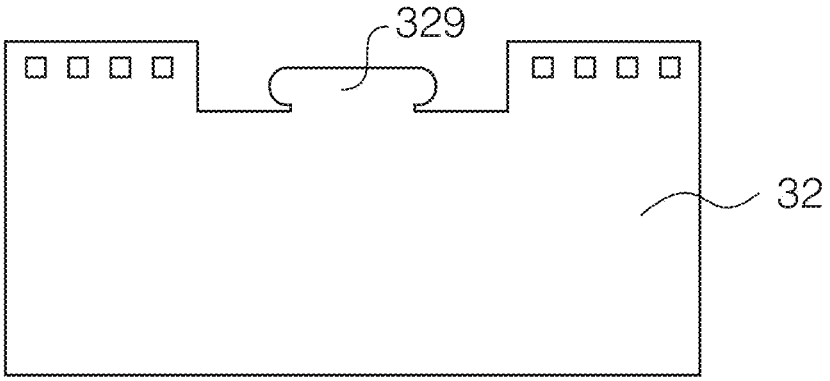
Figure 14D:
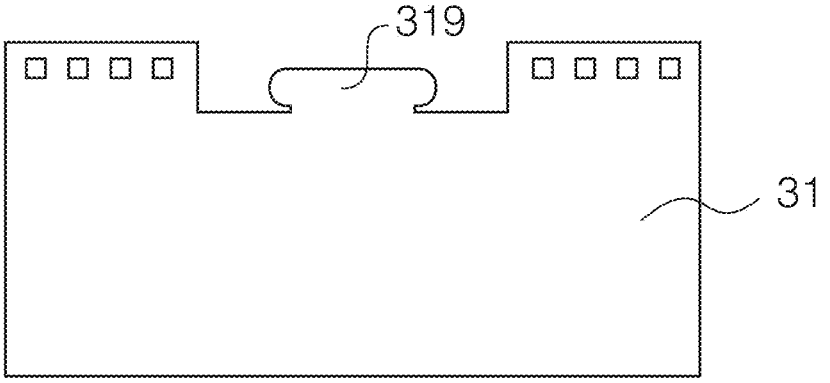
Figure 15:
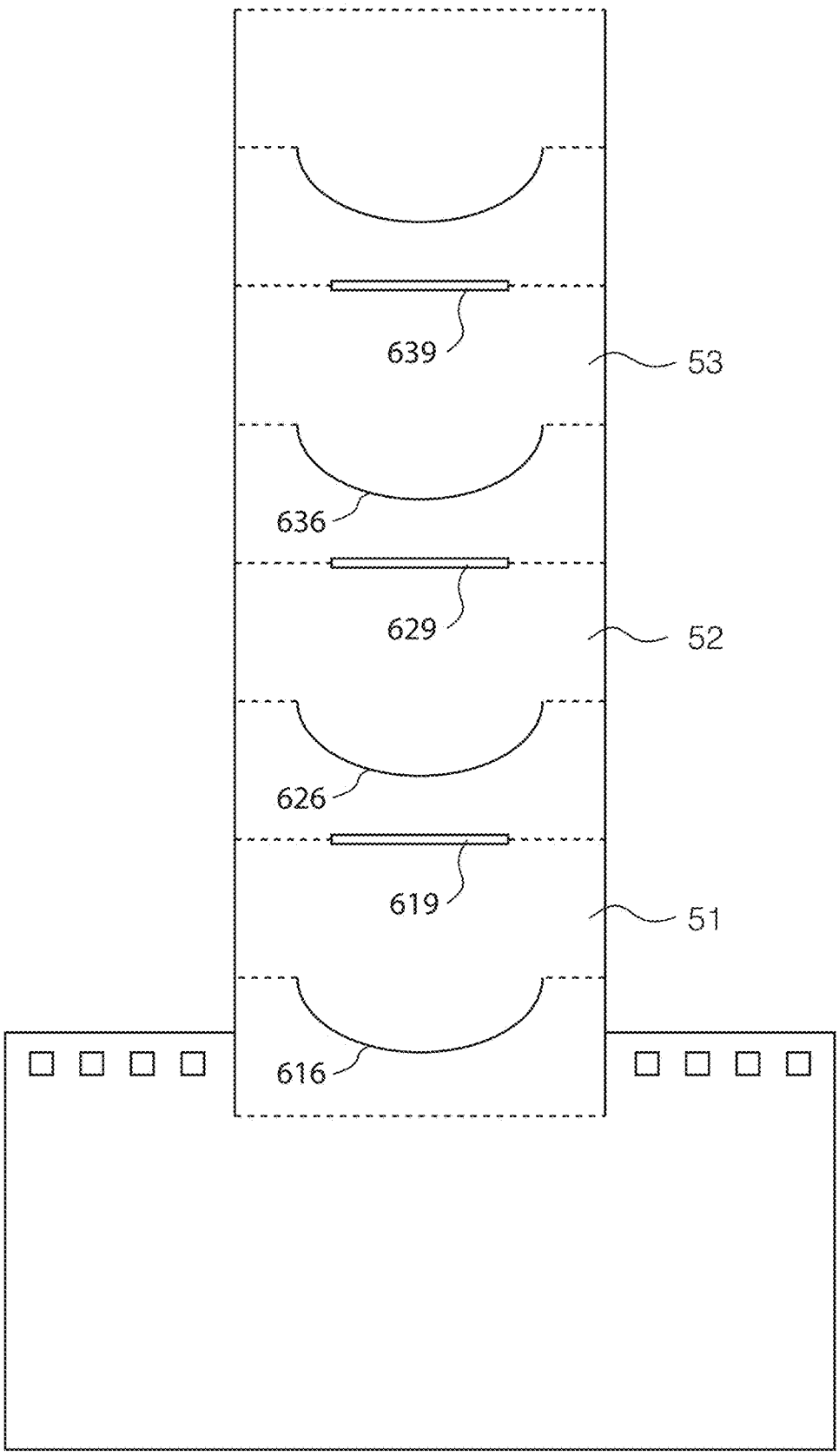
FIG. 15 depicts the graphic members when they are made by a single sheet of paper.
Figure 16:
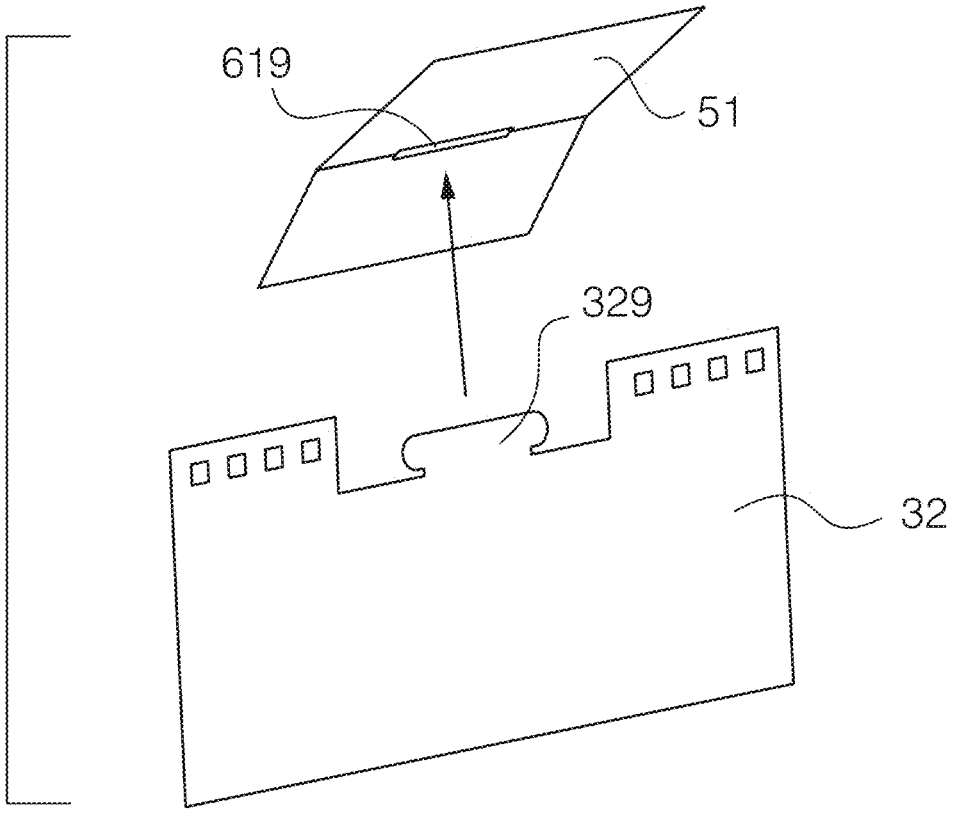
FIG. 16 depicts the vertical tab and its respective cut along part of the back folding straight line.
Figure 17A:
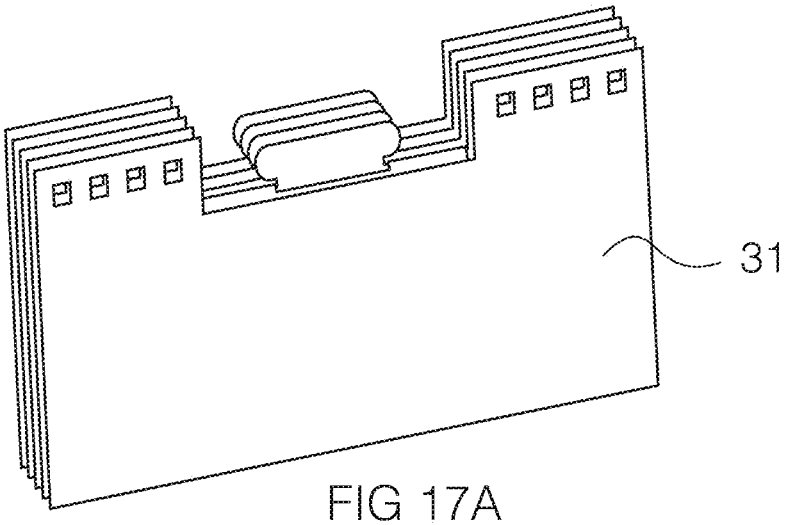
FIG. 17A depict plurality of pages with the tabs.
Figure 17B:
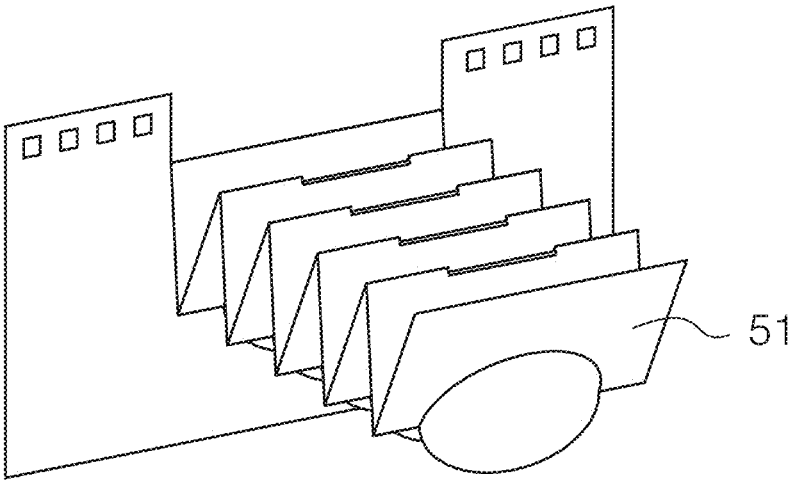
FIG. 17B depicts graphic members that are connected to each other and made by a single sheet of paper and that are correspond with the pages as depicted in FIG. 17A.
Figure 18A:
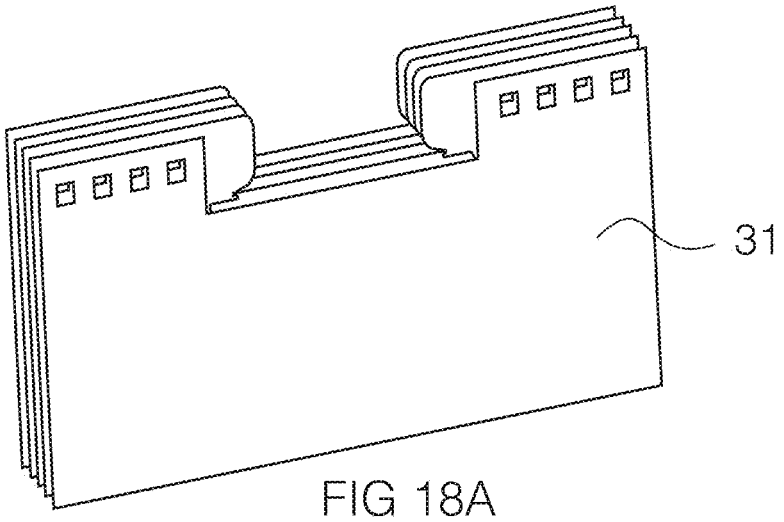
FIG. 18A depict plurality of pages with the cuts.
Figure 18B:
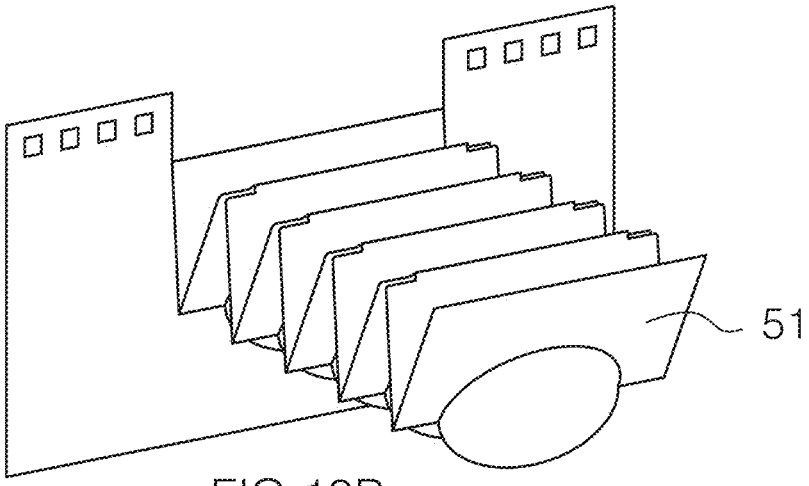
FIG. 18B depicts graphic members that are connected to each other and made by a single sheet of paper and that are correspond with the pages as depicted in FIG. 18A.
Figure 19:
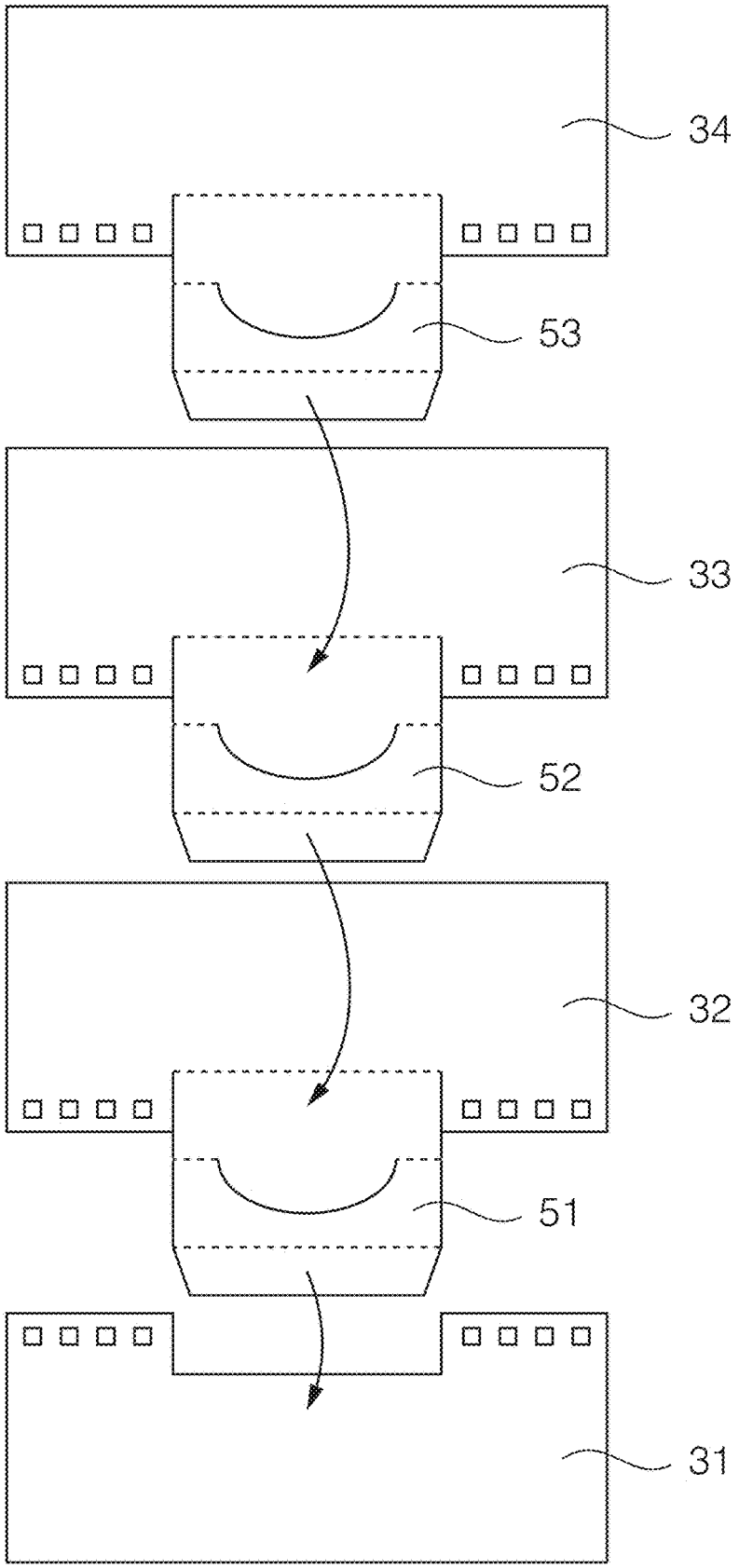
FIGS. 19 and 20 depict pages and graphic members when each page is integrally connected with a graphic member.
Figure 20:
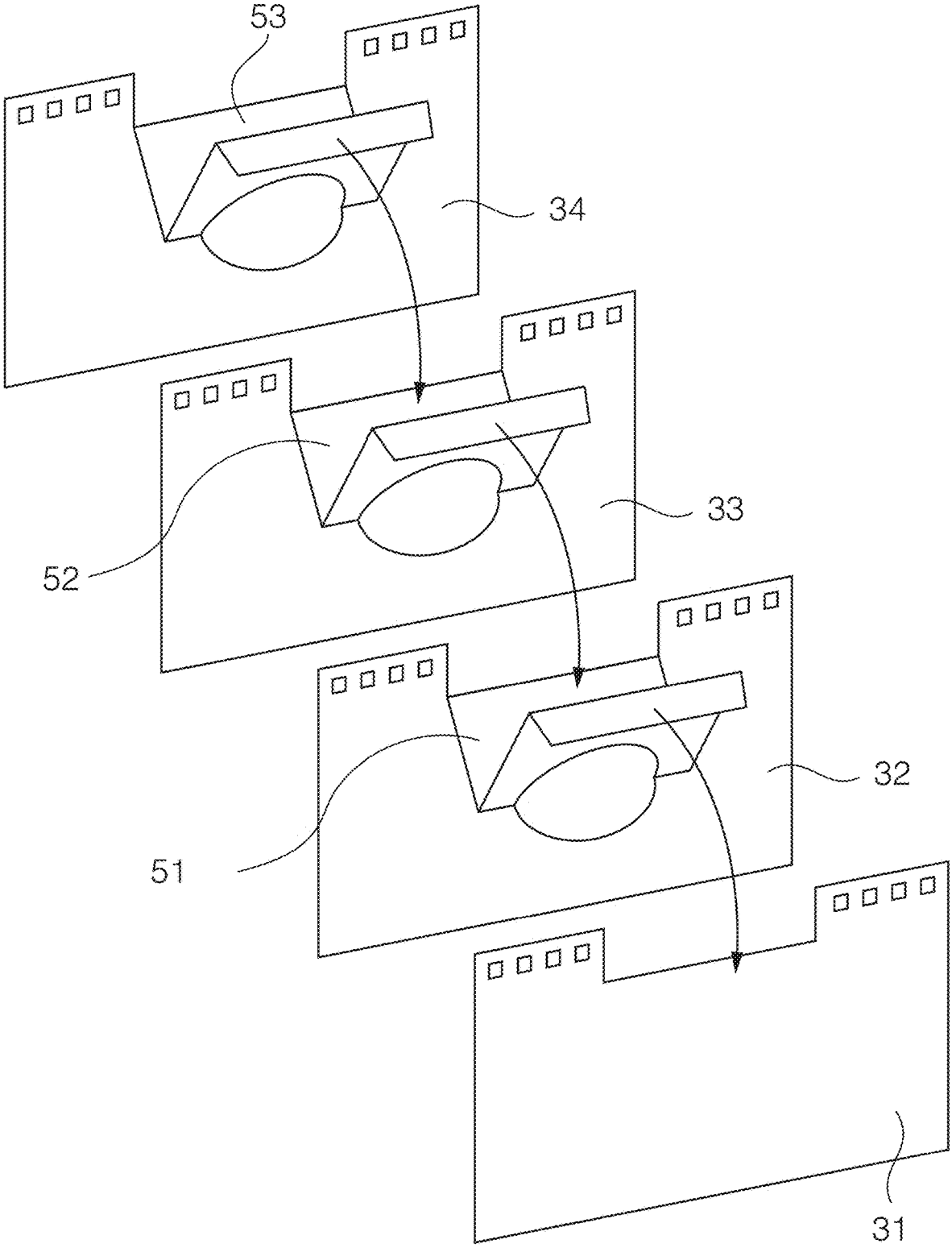

FIGS. 9A-9D depict four pages (31) (32) (33) (34), FIG. 10 depicts the first, second and third graphic members when they are connected to each other, FIG. 11 depicts the pages with the notches, FIGS. 12 and 13 depict the calendar in few states, FIG. 14A-14D depict four pages (31) (32) (33) (34), FIG. 15 depicts the graphic members when they are made by a single sheet of paper, FIG. 16 depicts the vertical tab and its respective cut along part of the back folding straight line, FIG. 17A depict plurality of pages with the tabs, FIG. 17B depicts graphic members that are connected to each other and made by a single sheet of paper and that are correspond with the pages as depicted in FIG. 17A, FIG. 18A depict plurality of pages with the cuts, FIG. 18B depicts graphic members that are connected to each other and made by a single sheet of paper and that are correspond with the pages as depicted in FIG. 18A, and FIGS. 19 and 20 depict pages and graphic members when each page is integrally connected with a graphic member (they are made by a single sheet of paper).

It is possible and even preferable that the graphic members will be made by a single sheet of paper and that they will be connected together integrally as depicted for example in FIGS. 10, 15, 17B, and 18B. The connection of a graphic member to its relevant page can be by glue (a strip along the folded line as depicted for example in FIG. 3) or by means of connecting means as depicted in the drawings, means by tabs, cuts, and insertions and the like). When preparing the graphic members from one single sheet of paper is it is possible that the first and the last graphic members will be ended with a page (or a paper panel to be attached to the pages) as depicted for example in FIGS. 10, 15, 17B and 18B. It is also possible to make the pages and the graphic members in pairs: each page is integrally connected to a graphic member (they can be made from a single sheet of paper) as depicted for example in FIGS. 19 and 20, so that the end of each graphic member will be attached to the next page.

What is claimed is:

1. A self-standing desktop calendar, comprising:

a plurality of pages that comprises at least a first page, a second page, a third page and a fourth page, wherein each page has a left top portion and a right top portion, with plurality of apertures, and a central upper notch between said left top portion and said right top portion, wherein the left top portions are rotatably connected to each other and the right top portions are rotatably connected to each other, by plurality of rings or a spool passing through their respective apertures;

a first graphic member that comprises a first front panel having a first front bottom edge and a first back panel having a first back bottom edge, wherein the first front panel and the first back panel are connected one to the other along a first central folded line A-E;

wherein the first front bottom edge of the first front panel is foldabley connected to the first page, and the first back bottom edge of the first back panel is foldabley connected to the second page that is adjacent to the first page; wherein the first graphic member is designed to be folded into a flat state when the first and the second pages are tight to each other throughout their area, and to unfold into an open state when the first page is turned back;

a second graphic member that comprises a second front panel having a second front bottom edge and a second back panel having a second back bottom edge, wherein the second front panel and the second back panel are connected one to the other along a second central folded line B-F;

wherein the second front bottom edge of the second front panel is foldabley connected to the second page, and the second back bottom edge of the second back panel is foldabley connected to the third page that is adjacent to the second page; wherein the second graphic member is designed to be folded into a flat state when the second and the third pages are tight to each other throughout their area, and to unfold into an open state when the second page is turned back;

a third graphic member that comprises a third front panel having a third front bottom edge and a third back panel having a third back bottom edge, wherein the third front panel and the third back panel are connected one to the other along a third central folded line C-G;

wherein the third front bottom edge of the third front panel is foldabley connected to the third page, and the third back bottom edge of the third back panel is foldabley connected to the fourth page that is adjacent to the third page; and wherein the third graphic member is designed to be folded into a flat state when the third and the fourth pages are tight to each other throughout their area, and to unfold into an open state when the third page is turned back.

2. The self-standing desktop calendar of claim 1, wherein said first back bottom edge of said first graphic member is integrally connected to said second page that is adjacent to said first page; wherein said first back bottom edge of said second graphic member is integrally connected to said third page that is adjacent to said second page; and wherein said first back bottom edge of said third graphic member is integrally connected to said fourth page that is adjacent to said third page.

3. The self-standing desktop calendar of claim 1, wherein said first front bottom edge of said first graphic member is foldabley connected to said first page along central upper notch of the first page, and said first back bottom edge of the first graphic member is foldabley connected to said second page along central upper notch of the second page; wherein said second front bottom edge of said second graphic member is foldabley connected to said second page along central upper notch of the second page, and said second back bottom edge of the second graphic member is foldabley connected to said third page along central upper notch of the third page; and wherein said third front bottom edge of said third graphic member is foldabley connected to said third page along central upper notch of the third page, and said third back bottom edge of the third graphic member is foldabley connected to said fourth page along central upper notch of the fourth page.

4. The self-standing desktop calendar of claim 1, wherein each of said first, second, third and fourth pages that has said upper notch further includes a main connecting means;

wherein each of said first, second and third graphic members has a secondary connecting means;

wherein the first back bottom edge of the first back panel of the first graphic member is foldabley connected to the second page by the main connecting means of the first graphic member and the secondary connecting means of the second page;

wherein the second back bottom edge of the second back panel of the second graphic member is foldabley connected to the third page by the main connecting means of the second graphic member and the secondary connecting means of the third page;

wherein the third back bottom edge of the third back panel of the third graphic member is foldabley connected to the fourth page by the main connecting means of the third graphic member and the secondary connecting means of the fourth page.

5. The self-standing desktop calendar of claim 4, wherein each of said main connecting means is of a type of a right cut and a left cut that projects into each of said pages from each of said notches; and wherein each of said secondary connecting means is of a type of a straight right cut and a straight left cut in left and right ends of back folding straight lines of said first, second and third graphic members.

6. The self-standing desktop calendar according to claim 4, wherein each of said main connecting means is of a type of a vertical tab; and wherein each of said secondary connecting means is of a type of a cut along a part of back folding straight lines of said first, second and third graphic members.

* * * * *